United States Patent [19]

Matheson et al.

[11] 4,102,823

[45] Jul. 25, 1978

[54] LOW AND NON-PHOSPHATE DETERGENT COMPOSITIONS

[75] Inventors: J. Neal Matheson, Burlington, Canada; David L. Richardson, Cincinnati, Ohio

[73] Assignee: The Procter & Gamble Company, Cincinnati, Ohio

[21] Appl. No.: 524,991

[22] Filed: Nov. 18, 1974

Related U.S. Application Data

[63] Continuation of Ser. No. 313,317, Dec. 8, 1972, abandoned, which is a continuation-in-part of Ser. No. 302,446, Oct. 31, 1972, abandoned.

[51] Int. Cl.[2] ..... C11D 1/83; C11D 3/04; C11D 3/10; C11D 11/03

[52] U.S. Cl. ..... 252/533; 252/89 R; 252/531; 252/539; 252/540; 252/550; 252/558; 252/559

[58] Field of Search ..... 252/539, 540, 558, 559, 252/531, 533

[56] References Cited

U.S. PATENT DOCUMENTS

| | | | |
|---|---|---|---|
| 2,954,347 | 9/1960 | St. John | 252/109 |
| 3,324,038 | 6/1967 | Chaffee | 252/546 |
| 3,799,880 | 3/1974 | Kelley | 252/110 |
| 3,801,511 | 4/1974 | Lemoff | 252/135 |
| 3,850,852 | 11/1974 | Soutar | 252/536 |
| 3,868,336 | 2/1975 | Mazzola | 252/527 |

*Primary Examiner*—Dennis L. Albrecht
*Attorney, Agent, or Firm*—Richard C. Witte; George W. Allen; Robert B. Aylor

[57] ABSTRACT

Low- and no-phosphate granular spray-dried detergent compositions containing a mixed anionic/nonionic surfactant system, particular essential organic and/or inorganic salts, and a critical amount of moisture. Such compositions provide detergency and sudsing performance, physical characteristics and processability comparing favorably with conventional anionic surfactant-containing, fully-built detergent compositions.

14 Claims, No Drawings

LOW AND NON-PHOSPHATE DETERGENT COMPOSITIONS

CROSS REFERENCE TO RELATED APPLICATION

This application is a continuation of U.S. patent application Ser. No. 313,317 to Matheson and Richardson, filed Dec. 8, 1972, now abandoned, which is a continuation-in-part of U.S. patent application Ser. No. 302,446 to Matheson and Richardson, filed Oct. 31, 1972, now abandoned.

BACKGROUND OF THE INVENTION

The instant invention relates to granular detergent compositions containing a particular mixture of anionic and nonionic surfactants, particular amounts of certain organic and/or inorganic salts and moisture. Such compositions are formulated to provide either low or high sudsing and effective detergent performance as well as product stability. Such compositions can be prepared using conventional detergent processing equipment.

Commercial synthetic detergent compositions have for years employed substantial amounts of inorganic phosphate salts as builder materials. Such phosphate builder materials serve to sequester or complex mineral ions commonly found in household tap water in order to prevent such ions from interfering with cleaning performance of the synthetic surfactant in such compositions. Phosphate builders also contribute to the physical stability of granular detergent products.

However, some recent studies have indicated that the phosphate class of builder materials may present an ecological problem because of the ability of these materials to act as a nutrient that promotes the growth of algae, thereby accelerating the biological aging (eutrophication) of natural water bodies. As a consequence of the possible harmful effects of the continued use of phosphate builder materials in substantial quantities, attempts have been made to materially reduce or eliminate the need for phosphate salts in commercial detergent compositions.

One method for compensating for the absence of mineral sequestering phosphate builder salts in detergent formulations has been to synthesize compositions containing surfactant systems which are particularly insensitive to mineral hardness in laundering solution. Such surfactant systems have, for example, included relatively mineral insensitive mixtures of anionic and nonionic surfactants. (See U.S. Pat. Nos. 2,543,744; 2,744,874; 2,875,153; 3,528,925; 3,563,091 and 3,619,119, and the copending U.S. patent application of Collins, Ser. No. 222,363 filed Jan. 31, 1972.) However, since most common nonionic surfactants used in these systems are liquid at room temperature, many formulations containing anionic-nonionic surfactant mixtures have been liquid in nature.

Attempts to achieve acceptable low- or no-phosphate, granular, mixed anionic-nonionic detergent compositions (and the resulting commercial advantages of granular products) by conventional spray-drying techniques have not been entirely successful. Addition of a nonionic surfactant to a spray-dried or "blown" anionic surfactant-containing granule creates problems from a performance (sudsing), a processing and a granule stability standpoint.

While the addition of nonionic surfactant to such granules does render the surfactant system less sensitive to dissolved water hardness (i.e. $Ca^{++}$ and $Mg^{++}$ ions) and, hence, more suitable for underbuilt or non-built detergent formulations, such nonionic surfactant addition has a tendency to reduce the foaming and sudsing performance generally desired as a marketing advantage for heavy-duty laundry products. Furthermore, inclusion of nonionic surfactants into spray-dried detergent granules aggravates difficulties in processing such granules, i.e. the nonionic surfactant, imparts physical properties to detergent composition slurries which render pumping, crutching and spray drying of such slurries extremely difficult. Finally, inclusion of nonionic surfactant into blown detergent granules (coupled with the elimination or material reduction of hygroscopic phosphate salt levels) generally renders the granular end product more susceptible to caking, pourability problems and stability problems upon storage.

Accordingly, it is an object of the present invention to provide low- and no-phosphate, mixed anionic/nonionic surfactant-containing spray-dried detergent compositions which are effective for washing and laundering in mineral-containing water.

It is a further object of the present invention to provide low- and no-phosphate, mixed anionic/nonionic surfactant-containing spray-dried detergent compositions which can have sudsing levels comparable to those of conventional fully-built, high-sudsing, anionic-surfactant containing compositions.

It is a further object of the present invention to provide low- and no-phosphate, mixed anionic/nonionic surfactant-containing detergent compositions in granular form having commercially acceptable caking properties, pourability and storage stability.

It is a further object of the present invention to provide low- and no-phosphate, mixed anionic/nonionic surfactant-containing, spray-dried detergent compositions which can be processed with conventional spray-drying equipment and apparatus.

It has been surprisingly discovered that by combining a particular mixed anionic/nonionic surfactant system with particular organic and/or inorganic salts and moisture in particular essential concentrations, detergent compositions can be formulated which accomplish the above objectives and which are superior in performance, physical characteristics and processability to similar compositions presently known in the art.

SUMMARY OF THE INVENTION

The instant low- and no-phosphate granular spray-dried detergent compositions consist essentially of from about 10% to about 30% by weight of a mixed anionic/-nonionic surfactant system, from about 10% to about 90% by weight of certain organic and/or inorganic salts and from about 1% to 9% by weight of water. The mixed surfactant system contains anionic surfactant and nonionic surfactant in an anionic/nonionic weight ratio of from about 2.8:1 to 5:1. The anionic surfactant is either a sodium or potassium salt of a sulfated fatty alcohol containing from about 8 to 18 carbon atoms; a sodium or potassium salt of an alkyl benzene sulfonic acid in which the alkyl group contains from about 9 to 20 carbon atoms or a mixture of such surfactants. The nonionic surfactant in the mixed surfactant system is a nonionic surfactant produced by the reaction of one mole of a higher fatty alcohol containing from about 10 to 15 carbon atoms with from about 3 to 10 moles of ethylene oxide, and such a nonionic surfactant has a hydrophilic-lipophilic balance of from about 10 to 13.5.

The organic and/or inorganic salt component can be an alkali metal carbonate, an alkali metal silicate, an electrolyte salt selected from the group consisting of water-soluble alkali metal and alkaline earth metal carboxylates, sulfates and chlorides, or a mixture of such organic and/or inorganic salts.

DETAILED DESCRIPTION OF THE INVENTION

The instant detergent compositions consist essentially of three essential components -- a particular anionic/-nonionic surfactant system, certain organic and/or inorganic salts and moisture. These components, as well as optional components and composition preparation and utilization, are discussed in detail as follows.

The Surfactant System

From about 10% to about 30% by weight, preferably from about 18% to about 25% by weight, of the instant detergent compositions comprises a particular surfactant system containing a mixture of certain anionic and nonionic surfactants. Total surfactant levels greater than about 30% in the instant compositions present processing problems in spray-drying such compositions. Total surfactant levels lower than about 10% in the instant compositions result in lower sudsing and poorer performing compositions.

Surprisingly, only particular anionic and nonionic surfactants in particular amounts can be combined to realize a surfactant system which, when employed in the present composition, provides the requisite surfactant mineral insensitivity, composition processability and, if desired, high-sudsing performance.

The Anionic Surfactant

The anionic component of the surfactant system of the present composition can be any of several particular relatively high-sudsing, relatively mineral-sensitive anionic surfactants. Such anionic surfactants are selected from the group consisting of the sodium and potassium salts of sulfated fatty alcohols containing from about 8 to 18 carbon atoms, the sodium and potassium salts of alkyl benzene sulfonic acids in which the alkyl group contains from about 9 to 20 carbon atoms, and mixtures of these surfactants.

The sulfated fatty alcohol salts, commonly called alkyl sulfates, are produced from natural or synthetic fatty alcohols containing from about 8 to 18 carbon atoms. Natural fatty alcohols include those produced by reducing the glycerides of naturally occurring fats and oils. Fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, potassium tallow alkyl sulfate, sodium tallow alkyl sulfate, sodium coconut alkyl sulfate, potassium coconut alkyl sulfate and mixtures thereof. Highly preferred alkyl sulfates are sodium tallow alkyl sulfate, potassium tallow alkyl sulfate, potassium coconut alkyl sulfate and sodium coconut alkyl sulfate.

A second type of relatively high sudsing, relatively mineral-sensitive anionic surfactant useful in the compositions of the instant invention is that of the sodium and potassium salts of alkyl benzene sulfonic acids in which the alkyl group contains from about 9 to 20 carbon atoms. These compounds can be straight or branched chained and are described more fully in U.S. Pat. Nos. 2,220,099 and 2,477,383 incorporated herein by reference. Examples of suitable compounds of this type include sodium decyl benzene sulfonate, sodium undecyl benzene sulfonate, sodium dodecyl benzene sulfonate, sodium tridecyl benzene sulfonate, sodium tetradecyl benzene sulfonate, sodium tetrapropylene benzene sulfonate, potassium decyl benzene sulfonate, potassium undecyl benzene sulfonate, potassium tridecyl benzene sulfonate, potassium tetradecyl benzene sulfonate, potassium tetrapropylene benzene sulfonate and mixtures thereof. Expecially preferred for use in the instant detergent compositions are the sodium and potassium salts of straight chain alkyl benzene sulfonic acids in which the alkyl group contains from about 11 to about 14 carbon atoms. Highly preferred surfactants of this type are sodium linear alkyl benzene sulfonate wherein the alkyl chain length averages about 12 carbon atoms and sodium linear alkyl benzene sulfonate wherein the alkyl chain length averages about 13 carbon atoms.

Mixtures of the above-described alkyl sulfate salts and alkyl benzene sulfonate salts are also operable as the anionic component of the surfactant system of the present compositions.

The Nonionic Surfactant

The second component of the surfactant system of the compositions of the instant invention is a nonionic surfactant produced by the condensation of one mole of a higher fatty alcohol containing from about 10 to 15 carbon atoms with about 3 to 10 moles of ethylene oxide, said nonionic surfactant having a hydrophilic-lipophilic balance (HLB) of from about 10 to about 13.5. Surprisingly only nonionic surfactants falling within these ranges provide acceptable sudsing performance.

Examples of such nonionic surfactants include the condensation product of one mole of lauryl fatty alcohol with about 6 moles of ethylene oxide, the condensation product of one mole of decyl fatty alcohol with about 4 moles of ethylene oxide the condensation product of one mole of tridecyl alcohol with about 6 moles of ethylene oxide, the condensation product of a secondary fatty alcohol containing about 15 carbon atoms with about 5 moles of ethylene oxide, the condensation product of one mole of tridecyl alcohol with about 8 moles of ethylene oxide, the condensation product of one mole of coconut fatty alcohol with about 6.5 moles of ethylene oxide, the condensation product of one mole of coconut fatty alcohol with about 7 moles of ethylene oxide, and the condensation product of a secondary fatty alcohol containing about 15 carbon atoms with about 9 moles of ethylene oxide.

Examples of commercially-available nonionic surfactants of the type operable in the instant invention include: Tergitol 15-S-7, Tergitol 15-S-9 and Tergitol 3-A-6, marketed by the Union Carbide Corporation; Kyro EOB, marketed by the Procter & Gamble Company; SynLube TDA-92, marketed by the Sylvan Chemical Company; and Neodol 23-6.5, Neodol 25-7 and Neodol 25-9, marketed by the Shell Chemical Company.

Preferred nonionic surfactants include the condensation product of tridecyl alcohol with about 6 moles of ethylene oxide, the condensation product of coconut fatty alcohol with about 6.0 moles of ethylene oxide, the condensation product of a secondary fatty alcohol containing about 15 carbon atoms with about 9 moles of ethylene oxide, Neodol 23-6.5 and Neodol 25-9, marketed by the Shell Chemical Company, and Tergitol 15-S-9, marketed by the Union Carbide Corporation. Neodol 23-6.5 is a condensation product of a primary alcohol containing from 12 to 13 carbon atoms and an average of 6.5 moles of ethylene oxide per mole of fatty alcohol; Neodol 25-9 is a condensation product of primary fatty alcohols containing from 12 to 15 carbon atoms with 9 moles of ethylene oxide per mole of fatty alcohol; and Tergitol 15-S-9 is a condensation product of a mixture of linear secondary fatty alcohols containing from 11 to 15 carbon atoms and 9 moles of ethylene oxide per mole of fatty alcohol.

Surfactant System Formulation

The anionic/nonionic surfactant system employed in the instant detergent compositions contains the above-described anionic and nonionic surfactants in a weight ratio of anionic surfactant to nonionic surfactant of from about 2.8:1 to 5:1, preferably about 4:1 when high-sudsing performance is desired and about 3:1 when low- or medium-sudsing performance is desired. Anionic/nonionic surfactant ratios within this range provide surfactant systems which are sufficiently mineral insensitive to be employed in on-phosphate detergent formulations, which can provide sudsing performace comparable either to that attained with conventional high-sudsing, fully-built detergent products or with conventional low-sudsing, fully-built detergent products. Such surfactant systems also present minimum processing difficulty during conventional spray-drying operations. Anionic/nonionic ratios greater than those specified above result in surfactant systems which are too mineral sensitive for use in low- and no-phosphate formulations whereas lower anionic/nonionic ratios than those specified above result in compositions which provide poorer sudsing performance and which are extremely difficult to spray dry.

Essential Organic and/or Inorganic Salts

From about 10% to about 90% by weight of the instant compositions, preferably from about 40% to about 50% by weight of the instant compositions, comprises certain organic and/or inorganic salts which serve to improve composition performance and facilitate spray drying of the instant compositions. Operably organic and/or inorganic salts of the instant invention are selected from the group consisting of alkali metal carbonates, alkali metal silicates, electrolyte salts selected from the group consisting of water-soluble alkali metal and alkaline earth metal carboxylates, sulfates and chlorides, and mixtures of such organic and/or inorganic salts.

Examples of suitable alkali metal carbonates include sodium carbonate, potassium carbonate, lithium carbonate, sodium sesquicarbonate, potassium sesquicarbonate and lithium sesquicarbonate. Sodium carbonate is highly preferred.

Alkali metal silicates are common silicon-containing compounds which are generally available commercially in many different physical and chemical forms. Water-soluble alkali metal silicates may be crystalline or amorphous, hydrated or anhydrous and can have varying ratios of alkali metal oxide ($M_2O$) to silica ($SiO_2$) within their structures. Generally such ratios vary on a weight basis from about 1:0.5 to 1:5.0. Examples of alkali metal silicates operable in the instant invention include sodium metasilicate, potassium metasilicate, sodium sesquisilicate, potassium sesquisilicate, sodium orthosilicate and potassium orthosilicate. Highly preferred compounds in the instant invention are those sodium silicates having a sodium oxide to silica weight ratio of from about 1:2.0 to 1:2.4.

Other operable organic and/or inorganic salts essentially present in the compositions of the instant invention include electrolyte salts selected from the group consisting of the water-soluble alkali metal and alkaline earth metal carboxylates, sulfates and chlorides. Examples of salts of this type include sodium acetate, potassium acetate, sodium citrate, sodium propionate, sodium nitrilotriacetate, sodium oleate, sodium stearate, sodium salt of coconut fatty acid, sodium salt of tallow fatty acid, potassium chloride, sodium chloride, magnesium sulfate and trisodium sulfosuccinate (described more fully in U.S. Pat. Nos. 3,328,314, 3,424,690 and 3,533,944, incorporated herein by reference).

Preferred electrolyte salts of this type are sodium acetate, potassium acetate, trisodium sulfosuccinate and magnesium sulfate. Highly preferred electrolyte salts are sodium acetate and trisodium sulfosuccinate.

In highly preferred no-phosphate embodiments of the instant detergent composition, mixtures of all three of the above-described types of organic and/or inorganic salts are employed. Generally such mixtures comprise (a) from about 40% to about 50% by weight of the organic and/or inorganic salt mixture of alkali metal carbonates, (b) from about 40% to about 50% by weight of the organic and/or inorganic salt mixture of alkali metal silicates having $M_2O/SiO_2$ weight ratios of from about 1:2.0 to about 1:2.4 and (c) from about 5% to about 20% by weight of the organic and/or inorganic salt mixture of electrolyte salts selected from the group consisting of sodium acetate, potassium acetate, alkali metal sulfosuccinate and magnesium sulfate. More preferably, such an organic and/or inorganic salt mixture comprises (a) from about 42% to about 46% by weight of the organic and/or inorganic salt mixture of sodium carbonate, (b) from about 42% to about 46% by weight of the organic and/or inorganic salt mixture of sodium silicate having a sodium oxide to silica weight ratio of about 1:2.4 and (c) from about 10% to about 15% by weight of the organic and/or inorganic salt mixture of sodium acetate.

In low-phosphate embodiments of the instant compositions (discussed more fully below), a preferred organic and/or inorganic salt component is an alkali metal silicate or mixtures of such silicates having $M_2O/SiO_2$ weight ratios of from about 1:2.0 to 1:2.4, present to the extent of from about 6% to 20% by weight of the composition. More preferably, such a salt is a sodium silicate or mixture of sodium silicates having $Na_2O/SiO_2$ weight ratios of from about 1:2.0 to 1:2.4, present to the extent of from about 6% to 13% by weight of the composition.

The main function performed by the above-described organic and/or inorganic salts and salt mixtures is to enable the compositions of the instant invention to be spray dried under conventional granular detergent spraydrying conditions. Detergent formulations employing the above-described organic and/or inorganic salts in the concentrations specified are more easily processed in crutchers and spray-drying towers.

In addition to serving as essential processing aids in the spray-drying of detergent compositions of the instant invention, the alkali metal carbonates and alkali metal silicates also serve to adjust the pH of aqueous laundering solutions of the instant compositions to values within the range of from about 9.5 to 10.5 within which range surfactant performance is maximized. Some of the above-described salts such as sodium carbonate, sodium nitrilotriancetate and sodium citrate also serve as detergent builders.

Water

The third essential component of the spray-dried detergent compositions of the instant invention is water or moisture. It has been discovered that detergent granules containing the particular anionic/nonionic surfactant system and particular organic and/or inorganic salt component described above can contain no greater than about 9% by weight moisture if free-flowing, non-caking detergent granules are desired. Accordingly, spray-dried compositions of the instant invention are dried during conventional spray-drying operations to a moisture content of from about 1% to 9% by weight. Preferably, detergent granules of the instant invention contain from about 3% to about 6% by weight water.

PREFERRED OPTIONAL COMPONENTS

Phosphate Salts

The instant detergent compositions can optionally contain, in a low-phosphate embodiment, from about 1% to about 35%, preferably from about 20% to 27%, by weight (as compared with a phosphate content of about 50% by weight in fully-built detergent compositions) of certain water-soluble polyvalent inorganic phosphate salts. Such water-soluble phosphate salts are selected from the group consisting of alkali metal pyrophosphates, alkali metal polyphosphates and alkali metal tripolyphosphates. Examples of phosphate compounds of this type include sodium tripolyphosphate, potassium tripolyphosphate, potassium hexametaphosphate, tetrapotassium pyrophosphate and sodium hexametaphosphate, tetrapotassium pyrophosphate and sodium pyrophosphate. A highly preferred phosphate salt is sodium tripolyphosphate.

Fatty Acid Suds Suppressing Agent

As noted above, detergent compositions of the instant invention employing the very particular type of nonionic surfactant specified provide surprisingly high sudsing performance under normal laundering conditions. Such high sudsing could, of course, be reduced or eliminated if desired merely by decreasing the anionic surfactant/nonionic surfactant weight ratio to a value below the essential range specified above, i.e. by increasing the amount of nonionic surfactant in the composition. This means of suds inhibition, however, would compound problems of processing the instant detergent composition. It has been discovered that the high sudsing compositions of this instant invention can be modified to provide lower sudsing performance without reduction in their processability by the optional addition of a particular type of suds-suppressing agent.

Such a suds suppressing agent is selected from the group consisting of fatty acids containing from about 8 to about 24 carbon atoms and mixtures of such fatty acids. Suitable fatty acids can be obtained from natural sources such as, for example, plant or animal esters (e.g. palm oil, coconut oil, babassu oil, soybean oil, safflower oil, tall oil, wallflower oil, castor oil, tallow, whale and fish oils, grease, lard, and mixtures thereof. Fatty acids also can be synthetically prepared (e.g. by the oxidation of petroleum or by hydrogenation of carbon monoxide via the Fischer-Tropsch process). Examples of suitable fatty acids for use in the instant invention include caproic acid, lauric acid, myristic acid, palmitic acid, stearic acid and palmitoleic acid and the mixtures of fatty acids described more fully in U.S. Pat. No. 2,954,347, incorporated herein by reference. Examples of commercially-available fatty acids for use as suds suppressing agents in the instant compositions include C-105, C-108, C-110, T-10, T-11 and OL-910, all marketed by The Procter & Gamble Company, and Hyfac, a hydrogenated fish oil fatty acid marketed by Emery Industries, Inc.

Preferred fatty acids for use herein include (1) mixtures of fatty acids derived from coconut oil and tallow, i.e. coconut fatty acid and tallow fatty acid, (2) hydrogenated fish oil fatty acid containing from about 17 to 18.5 carbon atoms, and (3) mixtures of said tallow fatty acid and said hydrogenated fish oil fatty acid.

If employed, the fatty acid component of the instant compositions comprises from about 0.5% to 5% by weight of the total composition. Preferably, the fatty acid component comprises from about 1% to about 4% by weight of the composition.

Other Optional Components

The detergent compositions of the instant invention can, in addition to the above-described essential components, contain a wide variety of non-interfering optional ingredients. Such optional components can, for example, include brighteners; hydrotropes and processing aids such as alkali metal toluene sulfonates; perfumes; bleaching agents such as sodium perborate solids or potassium monopersulfate; soil removal enhancers such as polyethylene glycol; enzymes; corrosion inhibitors, antiredeposition agents; calcium precipitate inhibitors; or coloring agents. Such optional materials can comprise up to about 50% by weight of the instant detergent composition.

Composition Preparation and Utilization

The low- and no-phosphate granular detergent compositions of the instant composition are prepared by spray-drying an aqueous slurry of the above-described detergent composition components. Conventional detergent spray-drying equipment can be utilized in such composition preparation. An aqueous slurry to be spray dried is prepared by admixing in a crutcher the above-described surfactant and organic and/or inorganic salt components with enough water to form a slurry containing from about 64% to 72% by weight solids, preferably about 68% by weight solids. Crutcher temperature is generally maintained between about 130° F. and 195° F., preferably about 180° F. for no-phosphate embodiments; preferably about 145° F. for low-phosphate embodiments. Such a slurry is pumped to a conventional spray-drying tower wherein the material is spray dried into granular particles containing the requisite 1% to 9% by weight or moisture content. Preferred methods and apparatus for spray-drying the instant compositions are described in U.S. Pat. Nos. 3,629,951 and 3,629,955 incorporated herein by reference.

Compositions of the instant invention are employed by dissolving them in aqueous washing or laundering solution to the extent of from about 0.01% to about 2% by weight. Preferably, such compositions are utilized in water to the extent of from about 0.06% to about 0.18% by weight. This preferred concentration is approximated when about 0.5 to 1.5 cups of the instant detergent composition are added to the 17–23 gallons of water generally held by commercially-available washing machines. Washing solution pH provided by the instant composition generally varies between 9.5 and 10.5. Soiled fabrics or other articles are added to laundering liquor and cleansed in the usual manner.

The granular low- and no-phosphate, spray-dried detergent compositions of the instant invention are illustrated by the following examples:

EXAMPLE I

A spray-dried detergent composition is prepared having the following composition:

| Component | | | Wt. % |
|---|---|---|---|
| Surfactant system | | | 22% |
| Sodium tallow alkyl sulfate | 18% | wt. ratio anionic/nonionic = 4.5:1 | |
| Condensation product of one mole of a secondary fatty alcohol containing about 15 carbon atoms with about 9 moles of ethylene oxide (HLB = 13.3) | 4% | | |
| Sodium carbonate | | | 74% |
| Water | | | 4% |

Such a composition provides excellent fabric laundering performance when employed under conventional home laundering conditions in laundering liquor of 5 grains/gallon hardness with a composition concentration in laundering liquor of about 0.12% by weight. Under such conditions sudsing performance of the Example I composition compares favorably with that of conventional, fully built, high-sudsing anionic detergent formulations. Such a composition is pourable and is prepared with conventional spray-drying apparatus.

Compositions of substantially similar performance quality, physical characteristics and processability are prepared if, in the above-described Example I composition, the sodium tallow alkyl sulfate is replaced with an equivalent amount of potassium tallow alkyl sulfate, sodium coconut alkyl sulfate, potassium coconut alkyl sulfate, sodium decyl benzene sulfonate, sodium undecyl benzene sulfonate, sodium tridecyl benzene sulfonate, sodium tetradecyl benzene sulfonate, sodium tetrapropylene benzene sulfonate, potassium decyl benzene sulfonate, potassium undecyl benzene sulfonate, potassium tridecyl benzene sulfonate, potassium tetradecyl benzene sulfonate or potassium tetrapropylene benzene sulfonate.

Compositions of substantially similar performance quality, physical characteristics and processability are prepared if, in the above-described Example I composition, the condensation product of 15-carbon atom secondary alcohol with 9 moles of ethylene oxide is replaced with an equivalent amount of the condensation product of tridecyl alcohol with about 6 moles of ethylene oxide (HLB = 11.4), the condensation product of coconut fatty alcohol with about 6 moles of ethylene oxide (HLB = 12.0), Neodol 23-6.5 (HLB = 12), Neodol 25-9 (HLB = 13.1) or Tergitol 15-S-9 (HLB = 13.3).

Compositions of substantially similar performance quality, physical characteristics and processability are prepared if, in the above-described Example I composition, the sodium carbonate is replaced with an equivalent amount of sodium metasilicate, potassium metasilicate, sodium sesquisilicate, potassium sesquisilicate, sodium orthosilicate, potassium orthosilicate, sodium sesquicarbonate, potassium carbonate, sodium acetate, sodium propionate, potassium acetate, sodium nitrilotriacetate, magnesium sulfate, sodium citrate, sodium salt of tallow fatty acid, sodium chloride, or mixtures of (a) sodium silicate ($r$ = 1:2.4), (b) sodium carbonate and (c) sodium acetate.

EXAMPLE II

A phosphate-free, spray-dried detergent composition is prepared having the following composition:

| Component | | | Wt. % |
|---|---|---|---|
| Surfactant System | | | 24.7% |
| Sodium linear alkyl benzene sulfonate wherein the alkyl group averages about 11.8 carbon atoms in length | 20% | wt. ratio anionic/nonionic = 4.26:1 | |
| Condensation product of one mole of coconut fatty alcohol with about 6 moles of ethylene oxide (HLB = 12.0) | 4.7% | | |
| Sodium silicate ($Na_2O/SiO_2$* wt. ratio = 1:2.4) | | | 20.0% |
| Sodium carbonate* | | | 20.0% |
| Sodium acetate | | | 5.0% |
| Sodium sulfate** | | | 22.1% |
| Sodium toluene sulfonate | | | 2.0% |
| Water | | | 4.0% |
| Minors | | | balance |

*The essential organic and/or inorganic salt component of the above-described Example II is a mixture of sodium silicate, sodium carbonate and sodium acetate of the following composition: sodium silicate — 44.5% by weight of the organic and/or inorganic salt mixture; sodium carbonate —44.5% by weight of the organic and/or inorganic salt mixture; sodium acetate —11.1% by weight of the organic and/or inorganic salt mixture.

**Although sodium sulfate is an electrolyte salt as defined above, it is not preferred as an essential component of the instant composition and is generally present chiefly only as a by-product of surfactant preparation. The preferred mixture of essential organic and/or inorganic salts in the Example II composition, therefore, consists only of the carbonate-silicate-acetate mixture.

Such a composition provides excellent fabric laundering performance when employed under conventional home laundering conditions in a laundering liquor of 5 grains/gallon hardness with a composition concentration in laundering liquor of about 0.12% by weight. Under such conditions, sudsing performance of the Example II composition compares favorably with that of conventional, fully-built, high-sudsing anionic detergent formulations. Such a composition is readily pourable and storage stable and is prepared with conventional spray-drying apparatus.

Compositions of substantially similar performance quality, physical characteristics and processability are prepared if, in the above-described Example II composition, the sodium linear alkyl benzene sulfonate is replaced with an equivalent amount of sodium tallow alkyl sulfate, potassium tallow alkyl sulfate, sodium coconut alkyl sulfate, potassium coconut alkyl sulfate, sodium decyl benzene sulfonate, sodium undecyl benzene sulfonate, sodium tridecyl benzene sulfonate, sodium tetradecyl benzene sulfonate, sodium tetrapropylene benzene sulfonate, potassium decyl benzene sulfonate, potassium undecyl benzene sulfonate, potassium tridecyl benzene sulfonate, potassium tetradecyl benzene sulfonate, potassium tetrapropylene benzene sulfonate, or mixtures of these surfactants.

Compositions of substantially similar performance quality, physical characteristics and processability are prepared if, in the above-described Example II composition, the condensation product of coconut fatty alcohol with 6 moles of ethylene oxide is replaced with an equivalent amount of the condensation product of a secondary fatty alcohol containing about 15 carbon atoms with about 9 moles of ethylene oxide (HLB = 13.3); the condensation product of tridecyl alcohol with about 6 moles of ethylene oxide (HLB = 11.4); Neodol 23-6.5 (HLB = 12.0), Neodol 25-9 (HLB = 13.1), or Tergitol 15-S-9 (HLB = 13.3).

A composition of substantially similar performance quality, physical characteristics and processability is prepared if, in the above-described Example II composition, there is incorporated about 3% by weight of sodium perborate solids with all other components remaining in the same relative weight proportion.

EXAMPLE III

A low-phosphate, spray-dried detergent composition is prepared having the following composition:

| Component | | | Wt. % |
|---|---|---|---|
| Surfactant System | | | 21.5% |
| Sodium linear alkyl benzene sulfonate wherein the alkyl group averages about 11.8 carbon atoms in length | 17.0% | wt. ratio anionic/nonionic = 3.8:1 | |
| Condensation product of one mole of coconut fatty alcohol with about 6 moles of ethylene oxide | 4.5% | | |
| Sodium silicate ($Na_2O/SiO_2$ wt. ratio = 1:2.4) | | | 6.0% |
| Sodium silicate ($Na_2O/SiO_2$ wt. ratio = 1:2.0) | | | 6.0% |
| Sodium tripolyphosphate | | | 24.0% |
| *Sodium sulfate | | | 35.3% |
| Sodium toluene sulfonate | | | 1.7% |
| Water | | | 4.0% |
| Minors | | | balance |

*Although sodium sulfate is an electrolyte salt as defined above, it is not preferred as an essential component of the instant composition and is generally present chiefly as a by-product of surfactant preparation. The preferred essential organic and/or inorganic salt in the Example III composition, therefore, consists only of the mixture of sodium silicates having $Na_2O/SiO_2$ weight ratios of 1:2.0 and 1:2.4.

Such a composition provides excellent fabric laundering performance when employed under conventional home laundering conditions in a laundering liquor of 7 grains/gallon hardness with a composition concentration in laundering liquor of about 0.12% by weight. Under such conditions, sudsing performance of the Example III composition compares favorably with that of conventional, high-sudsing detergent formulations. Such a composition is readily pourable and storage stable and is prepared with conventional spray-drying apparatus.

Compositions of substantially similar performance quality, physical characteristics and processability are prepared if, in the above-described Example III composition, the sodium linear alkyl benzene sulfonate is replaced with an equivalent amount of sodium decyl benzene sulfonate, sodium undecyl benzene sulfonate, sodium dodecyl benzene sulfonate, sodium tridecyl benzene sulfonate, sodium tetradecyl benzene sulfonate, sodium tetrapropylene benzene sulfonate, potassium decyl benzene sulfonate, potassium undecyl benzene sulfonate, potassium tridecyl benzene sulfonate, potassium tetradecyl benzene sulfonate, potassium tetrapropylene benzene sulfonate, or mixtures of these surfactants.

Compositions of substantially similar performance quality, physical characteristics and processability are prepared if, in the above-described Example III composition, the coconut alcohol condensation product is replaced with an equivalent amount of the condensation product of a secondary fatty alcohol containing about 15 carbon atoms with about 9 moles of ethylene oxide (HLB = 13.3); the condensation product of tridecyl alcohol with about 6 moles of ethylene oxide (HLB = 11.4); Neodol 23-6.5 (HLB = 12.); Neodol 25-9 (HLB = 13.1) or Tergitol 15-S-9 (HLB = 13.3).

Compositions of substantially similar performance quality, physical characteristics and processability are prepared if, in the above-described Example III composition, the sodium tripolyphosphate is replaced with an equivalent amount of potassium tripolyphosphate, potassium hexametaphosphate, tetrapotassium pyrophosphate or sodium pyrophosphate.

A composition of substantially similar performance quality, physical characteristics and processability is prepared if, in the above-described Example III composition, there is incorporated about 2% by weight of sodium perborate solids with all other components remaining in the same appropriate relative weight proportion.

EXAMPLE IV

A low-phosphate, low-sudsing, spray-dried detergent composition is prepared having the following composition:

| Component | | Wt. % |
|---|---|---|
| Surfactant System | 12.15% | |
| Sodium linear alkyl benzene sulfonate wherein the alkyl group averages about 11.8 carbon atoms in length | 9.0% | wt. ratio anionic/nonionic = 2.86:1 |
| Condensation product of one mole of coconut fatty alcohol with about 6 moles of ethylene oxide (HLB = 12.0) | 3.15% | |
| Sodium silicate ($Na_2O/SiO_2$ wt. ratio = 1:2.4) | 12.0 % | |
| Sodium tripolyphosphate | 24.0 % | |
| *Sodium sulfate | 45.65% | |
| Hydrogenated fish oil fatty acid containing about 18 carbon atoms | 2.2 % | |
| Water | 2.5 % | |
| Minors | balance | |

*Although sodium sulfate is an electrolyte salt as defined above, it is not preferred as an essential component of the instant composition and is generally present chiefly as a by-product of surfactant preparation. The preferred essential organic and/or inorganic salt of the Example IV composition, therefore, consists only of the sodium silicate.

Such a composition provides excellent fabric laundering performance when employed under conventional home laundering conditions in a laundering liquor of 7 grains/gallon hardness with a composition concentration in laundering liquor of about 0.12% by weight. Under such conditions, sudsing performance of the Example IV composition compares favorably with that of conventional, low-sudsing detergent formulations. Such a composition is readily pourable and storage stable and is prepared with conventional spray-drying apparatus.

Compositions of substantially similar performance quality, physical characteristics and processability are prepared if, in the above-described Example IV composition, the sodium linear alkyl benzene sulfonate is replaced with an equivalent amount of sodium decyl benzene sulfonate, sodium undecyl benzene sulfonate, sodium dodecyl benzene sulfonate, sodium tridecyl benzene sulfonate, sodium tetradecyl benzene sulfonate, sodium tetrapropylene benzene sulfonate, potassium decyl benzene sulfonate, potassium undecyl benzene sulfonate, potassium tridecyl benzene sulfonate, potassium tetradecyl benzene sulfonate, potassium tetrapropylene benzene sulfonate, or mixtures of these surfactants.

Compositions of substantially similar performance quality, physical characteristics and processability are prepared if, in the above-described Example IV composition, the coconut alcohol condensation product is replaced with an equivalent amount of the condensation product of a secondary fatty alcohol containing about 15 carbon atoms with about 9 moles of ethylene oxide (HLB = 13.3); the condensation product of tridecyl alcohol with about 6 moles of ethylene oxide (HLB = 11.4); Neodol 23-6.5 (HLB = 12.0); Neodol 25-9 (HLB = 13.1) or Tergitol 15-S-9 (HLB = 13.3).

Compositions of substantially similar performance quality, physical characteristics and processability are prepared if, in the above-described Example IV composition, the sodium tripolyphosphate is replaced with an equivalent amount of potassium tripolyphosphate, potassium hexametaphosphate, tetrapotassium pyrophosphate or sodium pyrophosphate.

A composition of substantially similar performance quality, physical characteristics and processability is prepared if, in the above-described Example IV composition the hydrogenated fish oil fatty acid is replaced with an equivalent amount of tallow fatty acid or mixtures of tallow fatty acid and hydrogenated fish oil fatty acid containing about 18 carbon atoms.

WASH-WEAR TEST

Detergency performance of compositions of the instant invention is compared with that of a commercially-available built granular laundry detergent in a wash and wear test. The test employed is conducted in the following manner: Light-colored dress shirts, cotton T-shirts and other fabrics such as pillow cases are distributed among various individuals. Each dress shirt and T-shirt is worn for one normal working day under uniform conditions, and the other articles are used for their generally-intended purposes. The soiled clothes and fabrics are then washed in an automatic agitating-type washer, for a period of 10 minutes, with detergent solutions at 100° F. The detergents employed are the compositions of Examples II, III and IV at a concentration of 0.9 cup per 23 gallons of water and Tide, a commercially-available built granular detergent marketed by The Procter & Gamble Company, used at varying concentrations. Wash water of 2, 7, and 12 grains/gallon hardness is employed. After washing, the clothes are rinsed (6 spray rinses and one deep rinse) and then dried.

Direct visual comparisons are made by a panel of expert graders between pairs of shirts and fabrics worn and soiled by the same individual. The dress shirts, T-shirts and other fabrics used are graded on the degree of whiteness and the degree of cleaning obtained, paying particular attention on this latter feature to the dress shirt collars and cuffs and pillow cases. For purposes of this invention, the term "cleaning" or "cleanliness" measures the ability of a washing composition to remove actual soil lines or deposits such as at crease lines of collars and cuffs and on pillow cases where the soil has had an opportunity to become deeply embedded. Whiteness, on the other hand, is a more general concept which measures the ability of the cleaning composition to whiten areas which are only slightly or moderately soiled. The relative cleaning effectiveness of each detergent composition in each area is graded visually on a nine point scale under artificial light wherein the highest grade is assigned to the relatively best performance obtained.

Based upon such comparisons, it is found that the compositions of Example II, III and IV of the instant invention provide cleaning and whiteness performance comparable to that of equivalent amounts of the commercial detergent, Tide.

SUDSING PERFORMANCE TEST

The unusual sudsing consistency of the instant detergent compositions is demonstrated by means of a suds height evaluation test. The compositions of Example II and III, described above, and two commercially-available built granular detergent compositions, Tide and Cheer, both marketed by The Procter & Gamble Company, are utilized under varying conditions of wash water temperature, water hardness, detergent concentration, and soil loads in a General Electric top-loading automatic washer in a standard laundering operation. After 2, 5, 8 and 10 minutes, suds heights for each washing solution tested are measured in inches and averaged for at least 24 runs under each set of conditions. Product concentration varies from ½ to 1½ cups of detergent per 23 gallons wash water; water hardness is varied from 0.5 grain/gallon to about 14 grains/gallon; soil load is varied from moderate to very heavy; wash water temperature is varied from about 70° F. to about 140° F.

Over this wide variety of washing conditions, sudsing performance of the Example II and III compositions compares favorably with that of the commercial detergents, Tide and Cheer, with the Example II composition demonstrating less susceptibility to change in the varying conditions than the commercial detergents Tide and Cheer.

The unexpected high-sudsing consistency realized by utilizing the particular nonionic surfactants specified above in the instant compositions is demonstrated by comparing in the above-described sudsing performance test sudsing of the Example II composition described above and an identical composition utilizing a different nonionic surfactant. When the coconut fatty alcohol condensation product of the Example II composition is replaced with an equivalent amount of another ethoxylated fatty alcohol, i.e. the condensation product of 1 mole of tallow fatty alcohol with about 11 moles of ethylene oxide (HLB = 12.98, average chain length = 17.4 carbon atoms), high-sudsing performance and consistency is significantly poorer.

Sudsing performance of a low-sudsing embodiment of the instant invention is also demonstrated by the above-described sudsing test. In such testing, the sudsing performance of the composition of Example IV is compared with sudsing performance of a commercially-available, low-sudsing detergent product, Dash, marketed by The Procter & Gamble Company. In such testing, the low-sudsing performance of the Example IV composition compares favorably with that of the commercial formulation, Dash.

STORAGE STABILITY TEST

Determination of the storage stability of compositions of the instant invention is made by a means of a storage stability test. Granular compositions tested are packed into outside waxed laminated and polylaminated cartons containing various types of closures and are stored in constant temperature-humidity chambers for various intervals of time. Such chambers generally are maintained under conditions varying from ambient temperature and humidity to the rather severe temperature-humidity conditions of 80° F. and 80% relative humidity. At specific intervals of time, compositions being tested are removed from the constant temperature-humidity environments and tested to determine caking and pourability properties after such storage.

Although such testing demonstrates that compositions of the instant invention are slightly poorer in storage stability than commercially-available, fully-built, phosphate-containing surfactant compositions, storage stability of the instant compositions is still acceptable for commercial use and sale.

What is claimed is:

1. A granular spray-dried detergent composition consisting essentially of:

(A) from about 10% to 30% by weight of a surfactant system consisting essentially of (i) an anionic surfactant selected from the group consisting of (a) the sodium and potassium salts of sulfated fatty alcohols, said alcohols containing from about 8 to 18 carbon atoms;

(b) the sodium and potassium salts of alkyl benzene sulfonic acids in which the alkyl group contains from 9 to 20 carbon atoms; and, (c) mixtures thereof; and (ii) a nonionic surfactant produced by the reaction of one mole of a higher fatty alcohol containing from 10 to 15 carbon atoms with from about 3 to 10 moles of ethylene oxide, said nonionic surfactant having a hydrophiliclipophilic balance of from about 10 to 13.5;

the weight ratio of anionic surfactant to nonionic surfactant within said surfactant system varying between 2.8:1 and 5:1;

(B) from about 10% to 90% by weight of a mixture of salts comprising from about 40% to 50% by weight of said salt mixture of alkali metal carbonates; from about 40% to 50% by weight of said salt mixture of alkali metal silicates having $M_2O/SiO_2$ weight ratios of from about 1:2.0 to 1:2.4, and from about 5% to 20% by weight of said salt mixture of an electrolyte salt selected from the group consisting of sodium acetate, potassium acetate, alkali metal sulfosuccinate, and magnesium sulfate; and (C) from about 3% to 6% by weight of water.

2. A composition in accordance with claim 1

(A) wherein the surfactant system is present to the extent of from about 18% to 25% by weight; and (B) wherein the organic and/or inorganic salt is present to the extent of from about 40% to 50% by weight.

3. A composition in accordance with claim 2 wherein the anionic surfactant is selected from the group consisting of sodium tallow alkyl sulfate, potassium tallow alkyl sulfate, potassium coconut alkyl sulfate, sodium coconut alkyl sulfate and the sodium and potassium salts of straight chain alkyl benzene sulfonic acids in which the alkyl group contains from 11 to about 14 carbon atoms.

4. A composition in accordance with claim 3 wherein the nonionic surfactant is selected from the group consisting of the condensation product of one mole of tridecyl alcohol with about 6 moles of ethylene oxide, the condensation product of one mole of coconut fatty alcohol with a secondary fatty alcohol containing about 15 carbon atoms with about 9 moles of ethylene oxide, a mixture of primary fatty alcohols containing 12 and 13 carbon atoms condensed with 6.5 moles of ethylene oxide per mole of alcohol, a mixture of primary fatty alcohols containing from 12 to 15 carbon atoms condensed with 9 moles of ethylene oxide per mole of fatty alcohol, and a mixture of linear secondary fatty alcohols containing from 11 to 15 carbon atoms condensed with 9 moles of ethylene oxide per mole of alcohol.

5. A phosphate-free detergent composition in accordance with claim 2

(A) wherein the weight ratio of anionic surfactant to nonionic surfactant is about 4:1 sulfate.

6. A composition in accordance with claim 5 (A) wherein the anionic surfactant is selected from the group consisting of sodium tallow alkyl sulfate, potassium tallow alkyl sulfate, potassium coconut alkyl sulfate and the sodium and potassium salts of straight chain alkyl benzene sulfonic acids in which the alkyl group contains from 11 to about 14 carbon atoms; and (B) wherein the nonionic surfactant is selected from the group consisting of the condensation product of one mole of tridecyl alcohol with about 6 moles of ethylene oxide, the condensation product of one mole of coconut alcohol with about 6 moles of ethylene oxide, the condensation product of a secondary fatty alcohol containing about 15 carbon atoms with about 9 moles of ethylene oxide, a mixture of primary fatty alcohols containing 12 and 13 carbon atoms condensed with 6.5 moles of ethylene oxide per mole of alcohol, a mixture of primary fatty alcohols containing from 12 to 15 carbon atoms condensed with 9 moles of ethylene oxide per mole of fatty alcohol, and a mixture of linear secondary fatty alcohols containing from 11 to 15 carbon atoms condensed with 9 moles of ethylene oxide per mole of alcohol.

7. A composition in accordance with claim 6 wherein the anionic surfactant is selected from the group consisting of sodium linear alkyl benzene sulfonate wherein the alkyl chain length averages about 12 carbon atoms and sodium linear alkyl benzene sulfonate wherein the alkyl chain length averages about 13 carbon atoms.

8. A composition in accordance with claim 7 wherein the organic and/or inorganic salt mixture comprises from about 42% to 46% by weight of said salt mixture of sodium carbonate, from about 42% to 46% by weight of said salt mixture of sodium silicate having a sodium oxide to silica weight ratio of about 1:2.4 and from about 10% to 15% by weight of said salt mixture of sodium acetate.

9. A low-phosphate detergent composition in accordance with claim 2:

(A) wherein the weight ratio of anionic surfactant to nonionic surfactant is about 4:1; and (D) wherein said composition additionally contains from about 1% to 35% by weight of a water-soluble polyvalent inorganic phosphate salt selected from the group consisting of alkali metal pyrophosphates and alkali metal polyphosphates.

10. A composition in accordanc with claim 9:

(A) wherein the anionic surfactant is selected from the group consisting of sodium tallow alkyl sulfate, potassium tallow alkyl sulfate, potassium coconut alkyl sulfate, sodium coconut alkyl sulfate and the sodium and potassium salts of straight chain alkyl benzene sulfonic acids in which the alkyl group contains from 11 to about 14 carbon atoms;

(B) wherein the nonionic surfactant is selected from the group consisting of the condensation product on one mole of tridecyl alcohol with about 6 moles of ethylene oxide, the condensation product of one mole of coconut alcohol with about 6 moles of ethylene oxide, the condensation product of a secondary fatty alcohol containing about 15 carbon atoms with about 9 moles of ethylene oxide, a mixture of primary fatty alcohols containing 12 and 13 carbon atoms condensed with 6.5 moles of ethylene oxide per mole of alcohol, a mixture of primary fatty alcohols containing from 12 to 15 carbon atoms condensed with 9 moles of ethylene oxide per mole of fatty alcohol, and a mixture of linear secondary fatty alcohols containing from 11 to 15 carbon atoms condensed with 9 moles of ethylene oxide per mole of alcohol; and (C) wherein said water-soluble polyvalent inorganic phosphate salt is selected from the group consisting of sodium tripolyphosphate, potassium tripolyphosphate, potassium hexametaphosphate, tetrapotassium pyrophosphate and sodium pyrophosphate.

11. A composition in accordance with claim 10

(A) wherein the anionic surfactant is selected from the group consisting of sodium liner alkyl benzene sulfonate wherein the alkyl chain length averages about 12 carbon atoms and sodium linear alkyl benzene sulfonate wherein the alkyl chain length averages about 13 carbon atoms;

(B) wherein the water-soluble, polyvalent, inorganic phosphate salt is sodium tripolyphosphate.

12. A low-phosphate, low-sudsing, detergent composition in accordance with claim 2:

(A) wherein the weight ratio of anionic surfactant to nonionic surfactant is about 3:1;

(B) wherein said composition additionally contains from about 1% to 35% by weight of a water-soluble polyvalent inorganic phosphate salt selected from the group consisting of alkali metal pyrophosphates and alkali metal polyphosphates; and (C) wherein said composition additionally contains from about 0.5% to 5% by weight of the composition of a suds suppressing agent selected from the group consisting of fatty acids containing from about 8 to 24 carbon atoms and mixtures of such fatty acids.

13. A composition in accordance with claim 12.

(A) wherein the anionic surfactant is selected from the group consisting of sodium tallow alkyl sulfate, potassium tallow alkyl sulfate, potassium coconut alkyl sulfate, sodium coconut alkyl sulfate and the sodium and potassium salts of straight chain alkyl benzene sulfonic acids in which the alkyl group contains from 11 to about 14 carbon atoms;

(B) wherein the nonionic surfactant is selected from the group consisting of the condensation product of one mole of tridecyl alcohol with about 6 moles of ethylene oxide, the condensation product of one mole of coconut alcohol with about 6 moles of ethylene oxide, the condensation product of a secondary fatty alcohol containing about 15 carbon atoms with about 9 moles of ethylene oxide, a mixture of primary fatty alcohols containing 12 and 13 carbon atoms condensed with 6.5 moles of ethylene oxide per mole of alcohol, a mixture of primary fatty alcohols containing from 12 to 15 carbon atoms condensed with 9 moles of ethylene oxide per mole of fatty alcohol, and a mixture of linear secondary fatty alcohols containing from 11 to 15 carbon atoms condensed with 9 moles of ethylene oxide per mole of alcohol;

(C) wherein said water-soluble polyvalent inoragnic phosphate salt is selected from the group consisting of sodium tripolyphosphate, potassium tripolyphosphate, potassium hexametaphosphate, tetrapotassium pyrophosphate and sodium pyrophosphate; and (D) wherein the suds suppressing agent is selected from the group consisting of coconut fatty acid, tallow fatty acid, hydrogenated fish oil fatty acid containing from about 17 to 18.5 carbon atoms and mixtures of tallow fatty acid and hydrogenated fish oil fatty acid containing from about 17 to 18.5 carbon atoms; said suds suppressing agent being present to the extent of from about 1% to 4% by weight of the total composition.

14. A composition in accordance with claim 13

(A) wherein the anionic surfactant is selected from the group consisting of sodium linear alkyl benzene sulfonate wherein the alkyl chain length averages about 12 carbon atoms and sodium linear alkyl benzene sulfonate wherein the alkyl chain length averages about 13 carbon atoms;

(B) wherein the water-soluble, polyvalent, inorganic phosphate salt is sodium tripolyphosphate.

* * * * *